US005871370A

United States Patent [19]

Kameyama et al.

[11] Patent Number: 5,871,370

[45] Date of Patent: Feb. 16, 1999

[54] CLIP FOR A MOVABLE CONNECTOR

[75] Inventors: Isao Kameyama; Hideto Kumakura, both of Shizuoka, Japan

[73] Assignee: Yazaki Corporation, Tokyo, Japan

[21] Appl. No.: 723,273

[22] Filed: Sep. 30, 1996

[30] Foreign Application Priority Data

Sep. 29, 1995 [JP] Japan ..... 7-253507

[51] Int. Cl.[6] ..... H01R 13/73

[52] U.S. Cl. ..... 439/557; 439/247; 439/567

[58] Field of Search ..... 439/247, 248, 439/557, 558, 567

[56] References Cited

U.S. PATENT DOCUMENTS

| | | | |
|---|---|---|---|
| 3,212,189 | 10/1965 | Mitchell et al. | 439/557 |
| 3,569,909 | 3/1971 | Garver | 439/557 |
| 4,664,458 | 5/1987 | Worth | 439/248 |
| 4,820,180 | 4/1989 | Mosquera et al. | 439/248 |
| 5,071,374 | 12/1991 | Plocek et al. | 439/752 |
| 5,199,900 | 4/1993 | Hayes, Sr. | 439/247 |
| 5,238,427 | 8/1993 | Fry et al. | 439/557 |
| 5,249,982 | 10/1993 | Funck et al. | 439/557 |
| 5,435,750 | 7/1995 | Kosmala | 439/567 |
| 5,514,000 | 5/1996 | Krause et al. | 439/248 |
| 5,658,167 | 8/1997 | Shindoh | 439/557 |

FOREIGN PATENT DOCUMENTS

| | | | |
|---|---|---|---|
| 62-37232 | 2/1987 | Japan | B60K 37/00 |
| 5-50610 | 7/1993 | Japan | F21Q 1/00 |

*Primary Examiner*—Neil Abrams
*Assistant Examiner*—Katrina Davis
*Attorney, Agent, or Firm*—Sughrue, Mion, Zinn, Macpeak & Seas, PLLC

[57] ABSTRACT

A clip for movably retaining a movable connector in a fitting hole. The clip includes a plurality of retaining clips, each being adaptable to abut against a respective side of the fitting hole by elastic force when the clip is inserted into the fitting hole. Each of the retaining clips have a retaining protrusion extending from its surface. The retaining protrusion has a tapered guide surface which is tapered along a direction of insertion of the clip into the fitting hole, and a tapered retaining surface which is also tapered along a direction of insertion of the clip into the fitting hole opposite to the guide surface. Each guide surface is adaptable to abut against a corresponding edge of the fitting hole so as to properly align the clip with the fitting hole during insertion. The retaining surface is adaptable to abut against a corresponding edge of the fitting hole when the retaining protrusion is in the fitting hole to movably secure the clip in the fitting hole. Thus, the guide surfaces function to absorb misalignment between the clip and the fitting hole, and the retaining surfaces function to absorb force which is applied to the clip so as to retain the clip in the fitting hole.

16 Claims, 7 Drawing Sheets

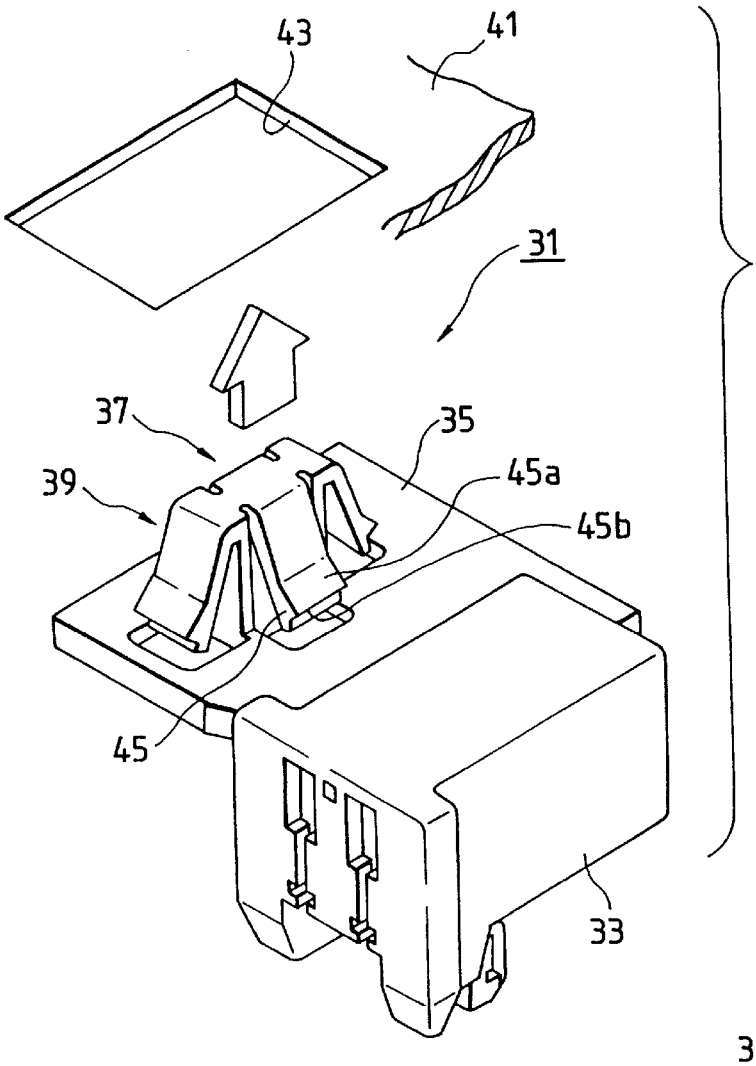
FIG. 1
FIG. 2
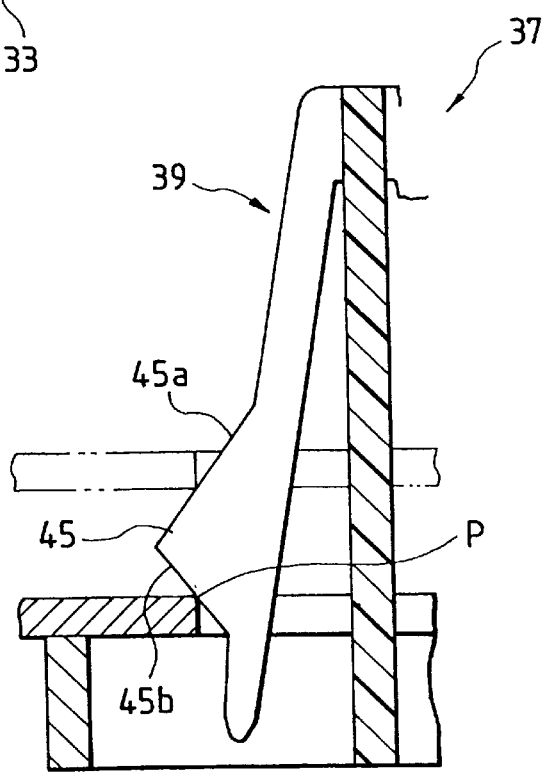

CLIP FOR A MOVABLE CONNECTOR

BACKGROUND OF THE INVENTION

1. Field of the Invention

The present invention relates to a clip for a movable connector and, more particularly, to a clip which movably secures a connector into an insertion hole, to thus facilitate mating of the connector with a mating connector.

2. Description of the Related Art

A motor vehicle, for example, typically includes many different types of electronic components that require electric power. As shown in FIG. 6, for instance, a room lamp 9 for illuminating the inside of the vehicle receives power from an electric wire 5, which is disposed between an outer plate 1 and the ceiling 3 of a vehicle compartment and is connected through a connector 7 to the lamp 9. The lamp 9 is fitted into a hole 11 formed in the ceiling 3, and is then secured with screws to the ceiling 3 which is secured to the outer plate 1.

If the electric wire 5 is not itself tied down or secured, however, it can become lodged between the edge portion of the fitting hole 11 and the lamp 9 when the lamp 9 is being fitted into the fitting hole 11. Moreover, the number of steps required to properly mount the lamp 9 tends to increase because the lamp 9 has to be fitted into the hole 11 after the electric wire 5 is drawn out of the fitting hole 11 to first be connected to the lamp 9. Furthermore, the lamp 9 has to be fitted into the hole 11 while the electric wire 5 is also forced back carefully into the hole 11 so as to prevent damage to the wire 5.

In order to solve these problems, an arrangement has been used in which the roof bow 13 is provided with a vehicle connector 15 that is connected to the electric wire 5. The lamp 9 is provided with a lamp connector 17 which mates with the vehicle connector 15 as shown in FIG. 7, so that the electrical connection is completed simultaneously with the installation of the lamp 9.

With this arrangement, vehicle connector 15 and the lamp connector 17 must be fit together when the lamp 9 is installed in the opening 11. Thus, these connectors must be aligned properly.

As described in Japanese Utility Model Laid-Open No. 50610/1993, in order to facilitate alignment of the connectors 15 and 17, a movable connector can be used as one of the connectors so as to absorb the positional shift in alignment by allowing the connector itself to move at the time of lamp installation. FIG. 8 is a side view of such a conventional movable connector 25, and FIG. 9 is an exploded perspective view of the movable connector shown in FIG. 8.

As shown, the movable connector 25 is rigidly fitted into a fitting hole 23 which is provided in a vehicle-body panel 21, and a lamp connector 27 and the movable connector 25 are connected together through a L-shaped sub-connector 30. The movable connector 25 includes elastic retaining pieces 29 attached to the respective sides of a cubic connector housing, and retaining parts 29*a* of the elastic retaining pieces 29 engage with the peripheral edge portion of the fitting hole 23 so that the movable connector 25 is held by the vehicle-body panel 21. One side of each retaining part 29*a* is tapered so as to be inserted in the fitting hole 23, and the other side acts as a retaining side which is parallel with the vehicle-body panel 21.

Since the movable connector 25 is held in the fitting hole 23 through the elastic retaining pieces 29, it can only move slightly due to the elastic deformation of the elastic retaining pieces 29, so that only a small positional shift of the movable connector 25 relative to the sub-connector 29 can be absorbed. Furthermore, as shown in FIG. 10, the elastic retaining pieces 29 of the movable connector are retained by the retaining sides 29*b* which abut against the peripheral edge portion of the fitting hole 23. It is noted that the position of the retaining side 29*b* is displaced by a dimension of a in the direction in which the retaining side 29*b* is fitted when the elastic retaining piece 29 is deflected, as shown by a chain double-dashed line. Therefore, deflection of the elastic retaining piece 29 results in a simultaneous deflection of the retaining side 29*b*. Hence, the retaining side 29*b* tends to readily slip off of the edge portion of the fitting hole.

Also, since the retaining side 29*b* is formed so that it is parallel to the vehicle-body panel 21, it only engages the edge of the panel 21 by a retaining width W. Therefore, the retaining side 29*b* tends to easily slip off the fitting hole 23 when the elastic retaining piece 29 is deflected.

If, on the other hand, the retaining side 29*b* is rigidly retained by the peripheral edge portion of the fitting hole 23, the elastic retaining piece 29 will also be prevented from deflecting. Therefore, the connector is unable to move sufficiently so as to absorb a shift in positions between connectors 15 and 17.

Additionally, in the above-described movable connector 25, the elastic retaining pieces 29 are retained in the rectangular fitting hole 23 in such a manner that the side walls of the elastic retaining pieces 29 are set parallel to the respective sides of the fitting hole 23, as shown in FIG. 11A. Therefore, as shown in FIG. 11B, when the movable connector 25 is turned about the central axis of insertion with respect to the fitting hole 23, the opposing elastic retaining pieces 29 deflect in directions toward each other, so that a distance d2 between two of them becomes less than the length d1 of the fitting hole 23, and a distance e2 between the other two of them becomes less than the width e2 of the fitting hole 23. Accordingly, the connector is either easily released from the hole 23, or becomes lodged in the hole and thus unable to move.

Additionally, when the central axis of the movable connector 25 is in parallel to the central axis c of insertion, the retaining side 29*b* is also set parallel to the vehicle-body panel 21 as shown in FIG. 12A. However, the retaining side 29*b* tilts when the central axis of the connector tilts with respect to the central axis c of insertion as shown in FIG. 12B. In this case, one end of retaining side 29*b* is separated by a dimension of f from the vehicle-body panel 21, and the connector 25 is unable to move as it is inserted into the hole in the vehicle-body panel 21 side. Also, the other end g of retaining side 29*b* which is in engagement with the vehicle-body panel 21 can easily slip away from the vehicle-body panel 21, thus allowing the connector to fall out of the fitting hole 23.

SUMMARY OF THE INVENTION

An object of the present invention, therefore, is to provide a clip for a movable connector whose fitting capability is improved by effectively making use of the elasticity of elastic retaining pieces to thereby sufficiently absorb a positional connector-to-connector shift when the movable connector is fitted in an opening in which a stationary mating connection is disposed.

In order to achieve this object, a clip for a movable connector, which is used for movably retaining the movable connector in a rectangular fitting hole, comprises a support plate coupled to a connector housing, and a plurality of clips which project from one side of the support plate. Each of the clips abut against a respective side of the fitting hole by due to their elastic force when the clips are inserted in the fitting hole. Each clip has a retaining protrusion formed on the outer side of the clip, and an inwardly tapered retaining surface which is formed on the rear side of the retaining protrusion in the direction opposite of insertion of the retaining protrusion. Each retaining surface abuts against a corresponding edge portion of the fitting hole to movably secure the clip in the fitting hole when the retaining protrusion has been inserted into fitting hole. Furthermore, a tapered guide surface which abuts against the edge portion of the insertion side of the fitting hole is formed on the front side of the retaining protrusion in the direction of insertion of the retaining protrusion.

Accordingly, even when the contact portion between each retaining surface and the fitting hole varies as the clip is deflected, the tapered retaining surface is always retained in the fitting hole. Moreover, since the contact portion is movable, the counterforce produced when the movement of the contact portion is prevented results in smooth movement of the movable connector.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, of which:

FIG. 1 perspective view of a movable connector assembly which includes a clip for a movable connector according to an embodiment of the present invention;

FIG. 2 is an enlarged side view of the clip shown in FIG. 1;

DETAILED DESCRIPTION OF THE PREFERRED EMBODIMENTS

Figure 3A:
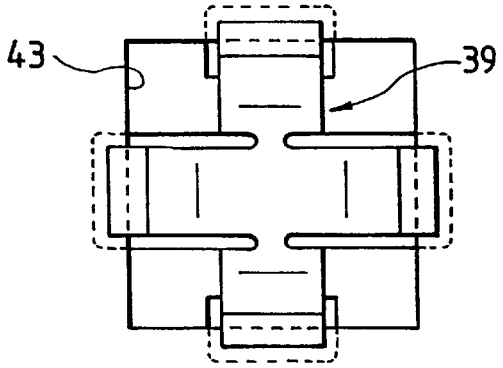
FIGS. 3A–3C are plan views illustrating movements of the movable connector shown in FIG. 1 due to loads applied thereto.

An embodiment of the present invention will now be described with reference to FIGS. 1 through 5.

In a clip according to an embodiment of the present invention as illustrated in FIGS. 1 and 2, a support plate 35 is coupled to or integral with a connector housing 33 of a movable connector 31 in a direction perpendicular or substantially perpendicular to the direction in which the a clip 37 of the connector is fitted into a rectangular fitting hole 43. The clip 37 for the movable connector projects from the surface of the support plate 35. Elastic retaining pieces 39 are provided in four places of the clip 37, and are retained at their respective sides of the rectangular fitting hole 43 formed in a roof bow 41 or the like.

The retaining pieces 39 are arranged so that their upper base sides are coupled together and the tip ends of their downward suspended portions form movable free ends. Of course, any suitable number or arrangement of retaining pieces 39 can be used so as to function properly with any suitably shaped fitting hole 43, and such retaining pieces 39 can be coupled together in any appropriate manner. The retaining pieces 39 are inserted in a direction such that their upper base sides first enter the fitting hole 43. A retaining protrusion 45 is formed on the surface of the tip end side of each retaining piece 39, and the retaining protrusion 45 is tapered in the longitudinal direction in which the clip 37 is inserted into the hole. The retaining protrusion 45 protrudes from the surface of its corresponding retaining piece 39 in a direction perpendicular to or substantially perpendicular to the direction of insertion of said clip 37 into said fitting hole 43.

When the clip 37 and hence the retaining pieces 39 are inserted in the fitting hole 43, each front tapered surface (tapered guide surface) 45*a*, which tapers in the direction in which the retaining protrusion 45 is inserted, abuts against its corresponding peripheral edge portion of the fitting hole 43, as shown by a chain double-dashed line in FIG. 2. As the retaining protrusion 45 of the retaining piece 39 is inserted further in the fitting hole 43, it deflects inward by the force from the peripheral edge portion of the fitting hole 43, and the top portion of the retaining protrusion 45 is allowed to pass the peripheral edge portion of the fitting hole 43. When the top portion passes the peripheral edge portion, the retaining portion 39 is again displaced outward by its elastic force and its rear tapered surface (tapered retaining surface) 45*b*, which inwardly tapers in the direction opposite in which the retaining protrusion 45 is inserted, abuts against the corresponding peripheral edge portion of the fitting hole 43, as shown in FIG. 2. The retained state of the retaining protrusions 45 is thus established.

Again, when the retaining protrusions 45 of the clip 37 for the movable connector are retained in the fitting hole 43, the tapered retaining surfaces 45*b* of the retaining pieces 39 are retained by the respective opposite sides of the fitting hole 43 and tentatively positioned as shown in FIG. 3A. At this time, the fitting hole 43 remains in abutment with a contact point P on each tapered retaining surface 45*b*, as shown in FIG. 2.

Figure 3B:
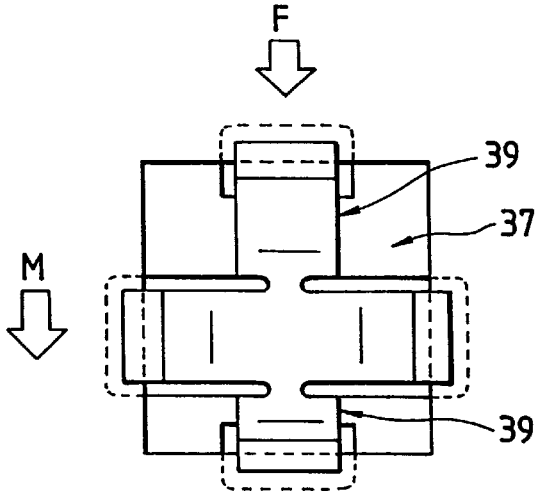

As shown in FIG. 3B, when a load F is applied from above to the movable connector 31 to absorb a positional shift, the clip 37 for the movable connector moves along the fitting hole 43 in the direction of an arrow M, and, as shown in FIG. 3B, the lower-side retaining piece 39 deflects inward while the upper-side retaining piece 39 opens outward due to its elastic force, so that the retaining pieces 39 are kept in engagement with their corresponding edges of the fitting hole 43. Moreover, the retaining pieces 39 are also kept in engagement with their corresponding edges of the fitting hole 43 even when a load is applied to the movable connector in a direction perpendicular to the direction in which the load F is applied as shown in FIG. 3B.

Figure 3C:
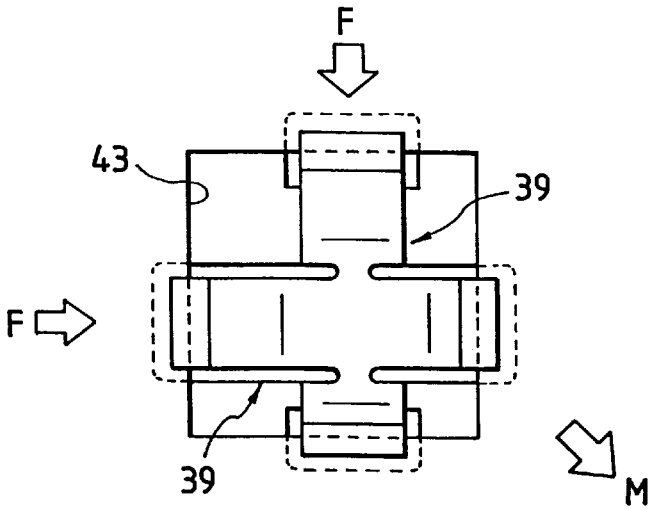

As further shown in FIG. 3C, the vertical and horizontal retaining pieces 39 are displaced independently even when loads F are applied from the upper and right directions of FIG. 3C, respectively. While each of the retaining pieces 39 is kept in engagement with its corresponding edge of the fitting hole 43, the clip 37 for the movable connector is then displaced in the diagonal direction of the fitting hole 43 in the direction along arrow M.

Figure 4:
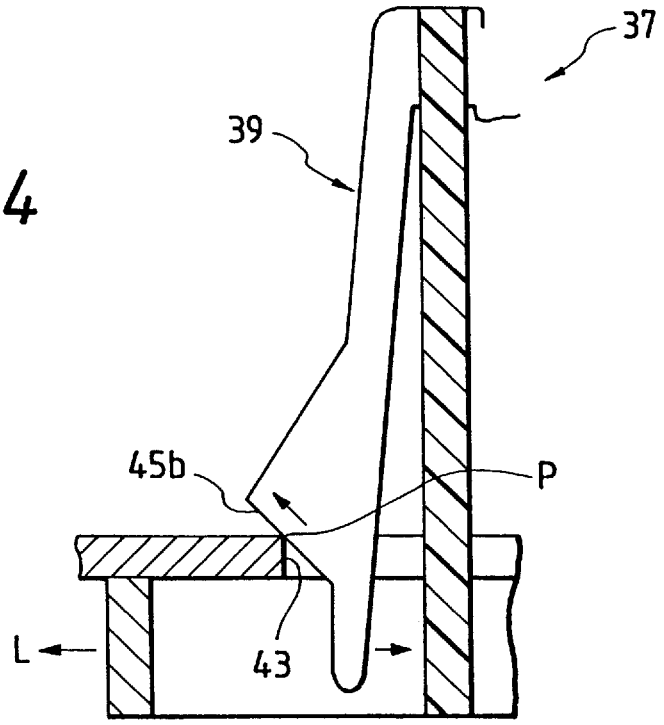
FIG. 4 is a side view showing a state in which the clip of FIG. 2 is deflected inward.
Figure 5:
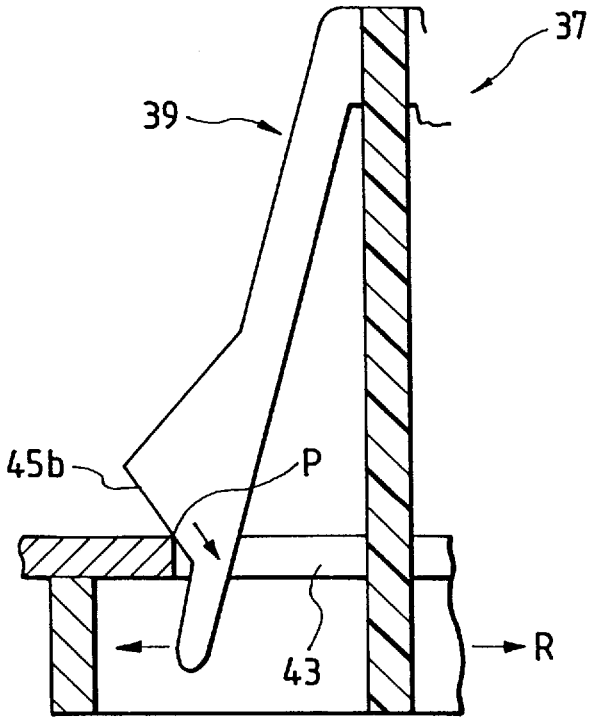
FIG. 5 is a side view showing a state in which the clip of FIG. 2 is displaced outward.
Figure 6:
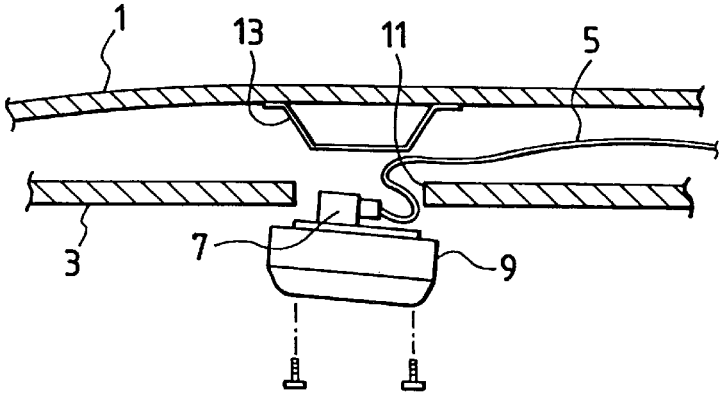
PRIOR ART FIG. 6
FIG. 6 is a sectional view showing a conventional room lamp mounting assembly.
Figure 7:
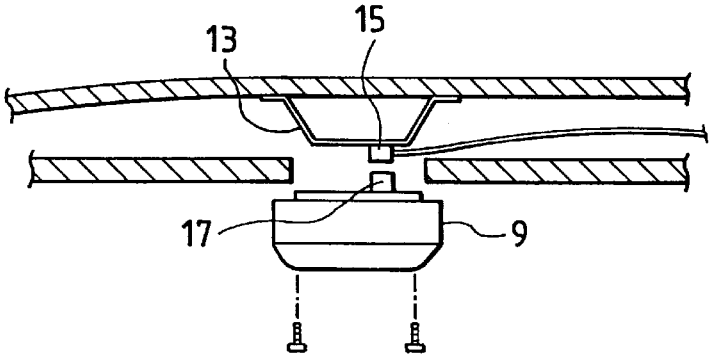
PRIOR ART FIG. 7
FIG. 7 is a sectional view showing a conventional room lamp mounting assembly which employs a conventional movable connector.
Figure 8:
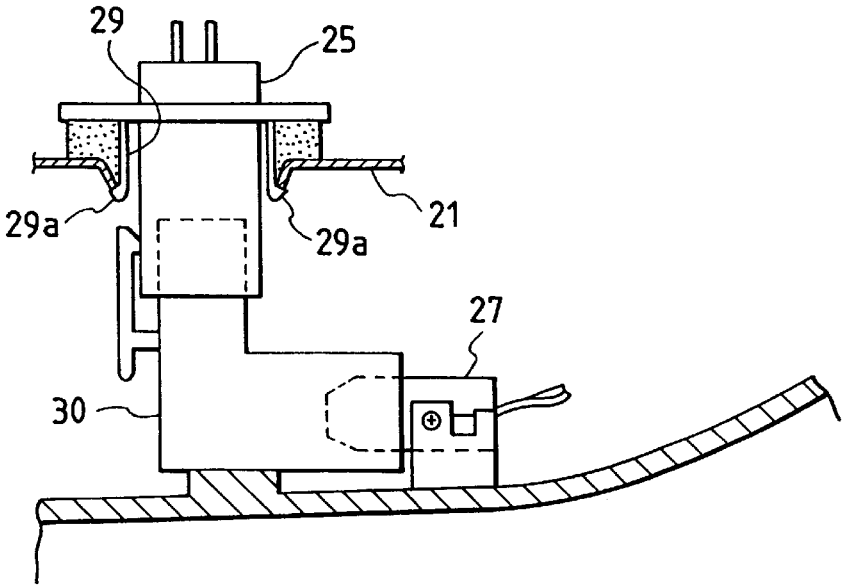
PRIOR ART FIG. 8
FIG. 8 is a side view of a conventional movable connector.
Figure 9:
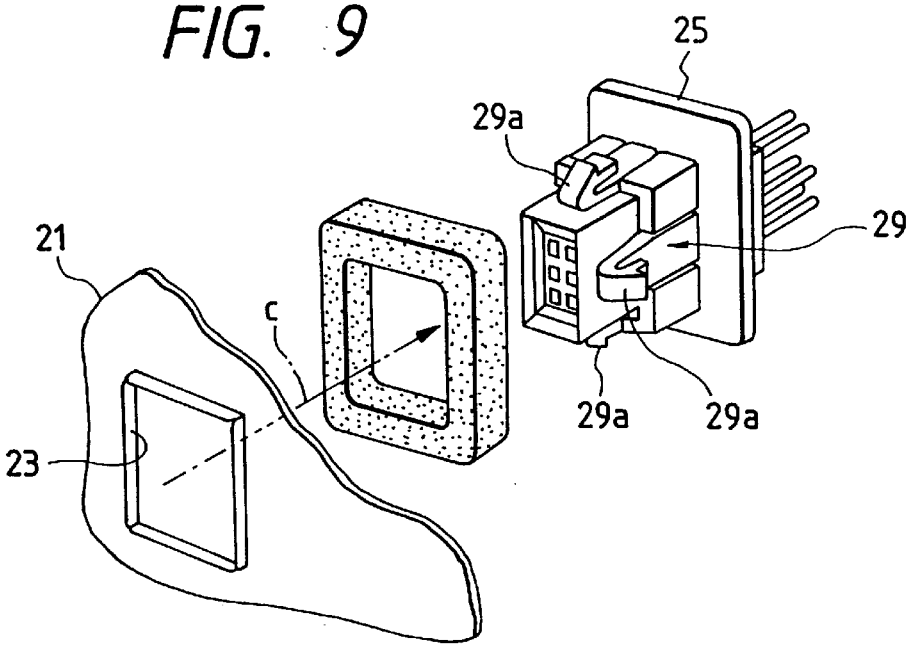
PRIOR ART FIG. 9
FIG. 9 is an exploded perspective view of the conventional movable connector shown in FIG. 8.
Figure 10:
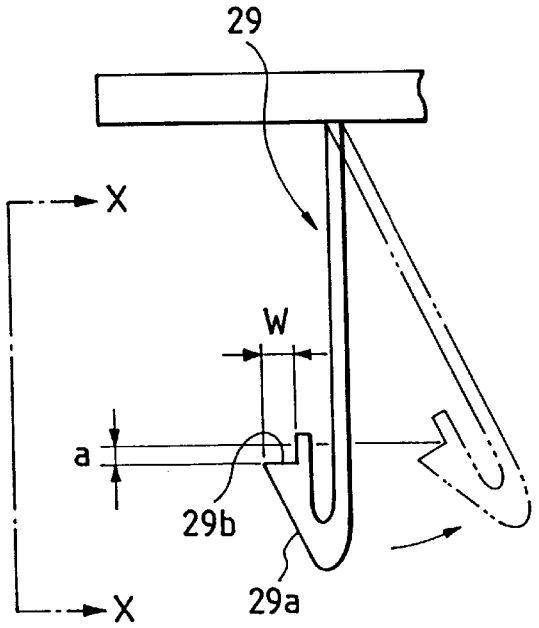
PRIOR ART FIG. 10
FIG. 10 is an enlarged side view of an elastic retaining piece of a conventional movable connector.
Figure 11A:
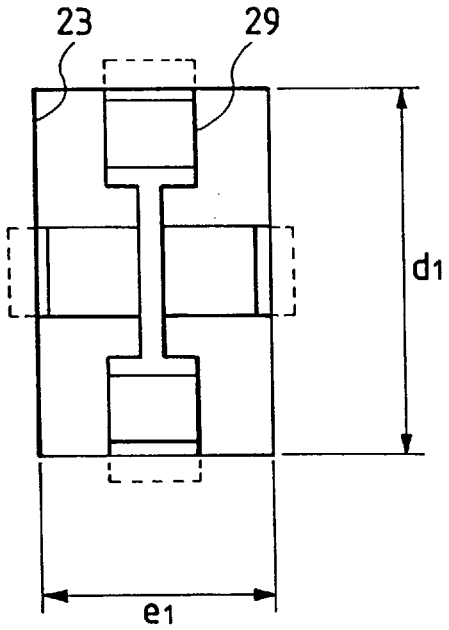
PRIOR ART FIG. 11(A)
FIGS. 11A and 11B are plan views of the elastic retaining piece of the movable connector in a retained condition.
Figure 11B:
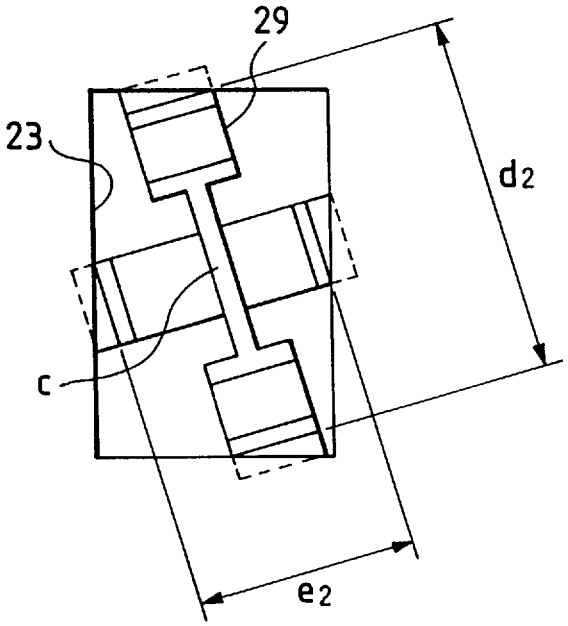
PRIOR ART FIG. 11(B)

The tapered retaining surface 45*b* of each of the retaining protrusions 45 is retained by the edge portion of the fitting hole 43 as shown in FIG. 4 when the retaining pieces 39 are thus displaced, and therefore, the contact point P moves in the upper direction of the tapered retaining surface 45*b* when, for example, the movable connector 31 is moved to the left (in the direction of an arrow L) so that the retaining piece 39 deflects inward. As further shown in FIG. 5, the contact point P moves in the lower direction of the tapered retaining surface 45*b* when the movable connector 31 is moved to the right (in the direction of an arrow R) so that the retaining piece 39 opens outward.

Hence, even when the contact point P between the retaining surface and the fitting hole 43 varies as the retaining piece 39 deflects, the tapered retaining surface 45*b* is kept in engagement with its corresponding edge of the fitting hole 43. In other words, the contact point P is movable along the tapered retaining surface 45*b* in order to allow the retaining protrusions 45 and hence the clip 37 to absorb any force that is applied thereto.

Figure 12A:
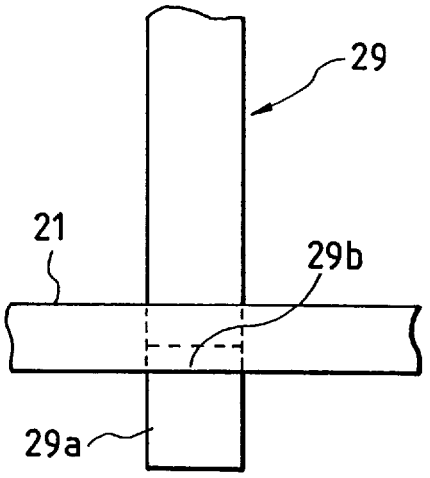
PRIOR ART FIG. 12(A)
FIGS. 12A and 12B are views of the retaining piece shown in FIG. 10 taken along direction 12—12.
Figure 12B:
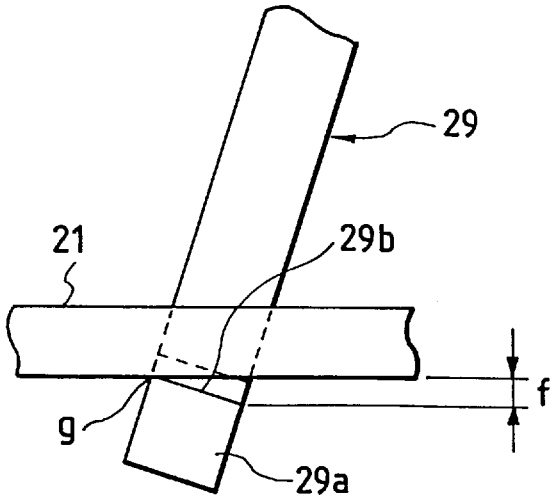
PRIOR ART FIG. 12(B)

Accordingly, even when the clip 37 tilts laterally, as shown in FIG. 12B with regard to the conventional connector, the edge portion of the fitting hole 43 slides on the corresponding tapered retaining surface 45*b*, thus keeping the retaining protrusion 45 in engagement therewith. Also, since the front tapered guide surface 45*a* is tapered in the direction in which the retaining protrusion 45 is inserted, as shown in FIG. 2, the tapered guide surface 45*a* abuts against the fitting hole 43 when it is inserted and the whole of the clip 37 for the movable connector is positioned in the center of the fitting hole 43. Hence, when the clip 37 for the movable connector is being inserted in the fitting hole 43 that cannot be viewed by the person performing the insertion, it is therefore possible for than individual to sense that the clip 37 has completely been positioned in the fitting hole 43.

As described above, the clip 37 for the movable connector according to this embodiment of the invention is configured such that the tapered retaining surface 45*b* of each retaining piece 39 can slidably be retained in the fitting hole 43. Hence, because the contact point P between the retaining surfaces and their corresponding edges of the fitting hole 43 vary as the clip 37 is deflected, force which acts on the movable connector 31 and also, force which obstructs the movement of the movable connector 31, can be absorbed. Consequently, the movable connector 31 can move enough to enable itself fit in the fitting hole.

Moreover, since the front tapered guide surface 45*a* is formed in the direction in which the retaining protrusion 45 is inserted, as shown in FIG. 2, the tapered guide surface 45*a* abuts against the fitting hole 43 when it is inserted. Therefore, the clip 37 for the movable connector can be guided to the predetermined position, so that its fitting capability with the fitting hole 43 is greatly improved.

The clip for the movable connector according to the present invention is not limited to the aforementioned embodiment, but rather, may be embodied in any other suitable form. For example, although the tapered retaining surfaces 45*a* and 45*b* have been described as being flat tilted surfaces, they may be concave curved surfaces or any other suitable configuration. The curved surface, for example, contributes to improving retaining force while securing the aforementioned sliding function.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A clip for movably retaining a movable connector in a fitting hole, comprising:

a plurality of retaining clips, each being adaptable to abut against a respective side of said fitting hole by elastic force when said retaining clips are inserted into said fitting hole, each of said retaining clips having a retaining protrusion formed thereon, said retaining protrusion having a tapered retaining surface which is tapered inwardly along a direction opposite of insertion of said retaining clip into said fitting hole wherein said tapered retaining surface abuts against a corresponding edge of said fitting hole when said retaining protrusion is completely inserted in said fitting hole and absorbs an external force acting on the clip in the direction of insertion, to allow the movable connector to move for facilitating self-alignment with a mating connector.

2. A clip for a movable connector as claimed in claim 1, wherein each of said retaining protrusions further include a tapered guide surface which is adaptable to abut against a corresponding edge portion of said fitting hole when said retaining protrusion is being inserted into said fitting hole.

3. A clip for a movable connector as claimed in claim 1, wherein said retaining clips are coupled together at one end thereof, and each have a said retaining protrusion at a distal end thereof.

4. A clip for a movable connector as claimed in claim 1, wherein the number of said retaining clips is four.

5. A clip for a movable connector as claimed in claim 4, wherein said four retaining clips are arranged about said clip to form a four-sided structure, with each of said clips constituting one side.

6. A clip for a movable connector as claimed in claim 1, wherein said retaining protrusion extends from a surface of said retaining clip in a direction substantially perpendicular to a direction of insertion of said clip into said hole, and said tapered retaining surface is tapered along said direction opposite of insertion from a first point on said retaining protrusion which is furthest from said surface of said retaining clip to a second point which is at said surface of said retaining clip.

7. A clip for a movable connector as claimed in claim 2, wherein said retaining protrusion extends from a surface of said retaining clip in a direction substantially perpendicular to said direction of insertion, and said tapered guide surface is tapered along said direction of insertion from a first point on said retaining protrusion which is furthest from said surface of said retaining clip to a second point which is at said surface of said retaining clip.

8. A clip for a movable connector as claimed in claim 6, wherein each of said retaining protrusions further include a tapered guide surface which is adaptable to abut against a corresponding edge portion of said fitting hole when said retaining protrusion is being inserted into said fitting hole, said tapered guide surface being tapered along said direction of insertion from said first point to a third point which is at said surface of said retaining clip.

9. A clip for a movable connector as claimed in claim 1, further comprising a support plate coupled to a connector housing which houses said movable connector, such that said retaining clips extend from said support plate in said direction of insertion.

10. A clip for a movable connector as claimed in claim 1, wherein said retaining clips are positioned with respect to each other to retain said clip in said fitting hole.

11. A clip for a movable connector as claimed in claim 1, wherein said retaining clips are positioned with respect to each other to retain said clip in said fitting hole which is a rectangular shaped fitting hole.

12. A clip for a movable connector as claimed in claim 1, wherein said retaining clips are made of an elastic material.

13. A method of using a clip to movably retain a movable connector in a fitting hole, said clip comprising a plurality of retaining clips, each of said retaining clips having a retaining protrusion formed thereon, said retaining protrusion having a tapered retaining surface which is tapered inwardly along a direction opposite of insertion of said retaining clip into said fitting hole and a tapered guide surface which is tapered along said direction of insertion, said method comprising the steps of:

inserting said clip into said fitting hole so that said tapered guide surfaces of said retaining protrusions of said retaining clips each contact a corresponding edge of said fitting hole;

applying a predetermined force to said clip to cause said tapered guide surfaces to convert said force into forces which urge said retaining clips in a direction substantially normal to said direction of insertion; and discontinuing application of said predetermined force when said tapered retaining surfaces are engaged within said fitting hole so that each of said tapered retaining surfaces contact a corresponding edge of said fitting hole so as to retain said clip in said fitting hole, and absorb an external force acting on the clip in the direction of insertion, to allow the movable connector to move for facilitating self-alignment with a mating connector.

14. A clip for a movable connector as claimed in claim 2, wherein said tapered guide surface intersects with said tapered retaining surface of said retaining protrusion.

15. A clip for a movable connector as claimed in claim 1, wherein each of said tapered retaining surface is movable with respect to said corresponding edge of said fitting hole when said retaining protrusion is completely inserted in said fitting hole.

16. A method of using a clip as claimed in claim 13, wherein each of said tapered retaining surface is movable with respect to said corresponding edge of said fitting hole when said retaining protrusion is completely inserted in said fitting hole.

* * * * *